US008820432B2

(12) United States Patent
Nelson

(10) Patent No.: US 8,820,432 B2
(45) Date of Patent: Sep. 2, 2014

(54) PNEUMATIC IMPULSE WRENCH WITH OPERATION CONTROL MEANS

(75) Inventor: Anders Urban Nelson, Alvsjo (SE)

(73) Assignee: Atlas Copco Industrial Technique Aktiebolag, Stockholm (SE)

( * ) Notice: Subject to any disclaimer, the term of this patent is extended or adjusted under 35 U.S.C. 154(b) by 439 days.

(21) Appl. No.: 12/992,351

(22) PCT Filed: May 8, 2009

(86) PCT No.: PCT/SE2009/000234
§ 371 (c)(1),
(2), (4) Date: Jan. 4, 2011

(87) PCT Pub. No.: WO2009/139683
PCT Pub. Date: Nov. 19, 2009

(65) Prior Publication Data

US 2011/0107881 A1 May 12, 2011

(30) Foreign Application Priority Data

May 14, 2008 (SE) ..... 0801087-8

(51) Int. Cl.
*B25B 23/145* (2006.01)
*B25B 23/14* (2006.01)

(52) U.S. Cl.
CPC ..... *B25B 23/1453* (2013.01); *B25B 23/145* (2013.01); *B25B 23/14* (2013.01); *B25B 23/1405* (2013.01); *B25B 23/1456* (2013.01)
USPC ..... 173/176; 173/2; 173/8; 173/9; 173/177

(58) Field of Classification Search
CPC ..... B25B 23/1456; B25B 23/1453; B25B 23/1405; B25B 23/14
USPC ..... 173/2, 8–9, 176, 177
See application file for complete search history.

(56) References Cited

U.S. PATENT DOCUMENTS 2,825,353 A * 3/1958 Voytech ..... 91/59
3,434,547 A * 3/1969 Mitani et al. ..... 173/183

(Continued)

FOREIGN PATENT DOCUMENTS

EP 0 900 632 A2 3/1999
WO WO 2005/063448 A1 7/2005

OTHER PUBLICATIONS

International Search Report dated Aug. 7, 2009 issued in International Appln. No. PCT/SE2009/000234.

*Primary Examiner* — Michelle Lopez
(74) *Attorney, Agent, or Firm* — Holtz Holtz Goodman & Chick PC

(57) ABSTRACT

A pneumatic impulse wrench for tightening screw joints includes a housing with a pressure air inlet passage, an exhaust air outlet passage, a rotation motor, a hydraulic impulse generator, and is connected to a stationary programmable control unit. The impulse wrench also includes a torque indicating mechanism connected to the control unit for feeding back electric signals responsive to the output torque of the wrench, an electromagnetically activated inlet valve arranged in the air inlet passage, and an electromagnetically activated exhaust valve which controls the exhaust air flow from the motor. The exhaust valve is a proportional valve activated by a linearly operated electromagnetic actuator and arranged to continuously adapt the exhaust air flow and, hence, the motor power to the characteristics of the actual screw joint being tightened in response to feed back signals from the torque indicating mechanism and in accordance with a programmed tightening strategy.

7 Claims, 2 Drawing Sheets

(56) References Cited

U.S. PATENT DOCUMENTS

| | | | | |
|---|---|---|---|---|
| 3,827,506 | A * | 8/1974 | Himmelstein et al. | 173/182 |
| 5,113,949 | A * | 5/1992 | Ohkubo et al. | 173/177 |
| 5,421,240 | A * | 6/1995 | Ohta et al. | 91/59 |
| 5,439,063 | A | 8/1995 | Anders et al. | |
| 6,135,213 | A | 10/2000 | Schoeps | |
| 6,843,326 | B2 * | 1/2005 | Tambini | 173/1 |
| 2002/0134172 | A1 * | 9/2002 | Yamada et al. | 73/862.21 |
| 2007/0151740 | A1 | 7/2007 | Friberg et al. | |

* cited by examiner

PNEUMATIC IMPULSE WRENCH WITH OPERATION CONTROL MEANS

This application is the U.S. national phase application of International application PCT/SE2009/000234 filed May 8, 2009.

The invention relates to a pneumatic impulse wrench for tightening screw joints and including air flow controlling means for controlling the torque impulse magnitude delivered by the wrench and for interrupting the air supply to the wrench as a screw joint tightening target is reached.

A problem concerned with pneumatic impulse wrenches is to accomplish an accurate control of the tool operation, in particular to control and vary the magnitude of the output impulses during the tightening processes. Owing to the dynamic forces involved in impulse tightening there is some difficulty in getting a correct information of the torque magnitude actually delivered to a screw joint. It is also difficult to get a fast enough acting control of the pressure air flow through the tool to enable an accurate control of the tightening process. All this requires an electrically operated torque indicating means, an electrically activated air flow controlling valve means, and an electronic process control and monitoring unit.

The historic reason why such a fast acting operation control has not been used at pneumatic impulse wrenches is that these tools normally lack access to electric power, which means that electrically operated sensing means to provide feed back signals during tool operation have not been able to use. Neither has it been possible to use programmable electronic control units for accurately controlling and monitoring the tool operation.

Another reason why the torque impulse magnitudes delivered by a pneumatic impulse wrench has not been accurately controlled is that there have not been available air flow controlling valves acting fast enough and being small enough to be located at the power wrench close to the motor of the wrench. A location of the flow controlling valves close to the wrench motor is crucial to get a fast acting and accurate tool operation control.

In recent years, however, it has been possible to incorporate these features in pneumatic impulse wrench systems, since electric power and suitable valves have been made available. This means that electronic operation control and monitoring units have been made possible to use.

Today, electronically controlled pneumatic impulse wrenches are a part of prior art, and an example of such an impulse wrench system is described in U.S. Pat. No. 5,439,063. The impulse wrench disclosed in that patent comprises a torque sensor generating electric signals in response to the output torque magnitude, a separate electronic control unit connected to the torque sensor, and a pressure-regulating valve located in the pressure air supply line and connected to the control unit. This arrangement makes it possible to vary the output torque of the impulse wrench during the tightening process so that the pressure air supply to the impulse wrench is reduced both at the beginning of the process to avoid overtightening by the first delivered impulse and when approaching the tightening target level. The signals obtained from the torque sensor onboard the wrench are used for governing the process, and the control unit is arranged to end the process by closing the pressure-regulating valve when a target torque level is reached. However, since the pressure regulating valve is located in the pressure air supply line at a distance from the wrench motor the operation control is rather slow.

In U.S. Pat. No. 6,135,213 there is described another power control technique for impulse wrenches including a rather simple control means wherein the exhaust air flow from the wrench motor is controlled by a pressure activated exhaust valve. This exhaust valve is controlled by the back pressure from the wrench motor, such that during the initial pre-seating stage of a screw joint tightening process the valve opens just partly to keep down the motor speed. After the screw joint has been seated and when the torque resistance from the screw joint increases the resultant increase in back pressure from the motor shifts the exhaust valve to a fully open condition, whereby full power output of the motor is obtained. Any further adjustment of the output torque is not possible.

It is an object of the invention to provide an improved pneumatic impulse wrench by which the output magnitude of the delivered impulses may be accurately controlled by a programmable control unit so as to obtain a desired accurate control of the wrench operation during screw joint tightening processes.

Further objects and advantages of the invention will appear from the following specification and claims.

A preferred embodiment of the invention is described below in detail with reference to the accompanying drawing.

In the drawings

Figure 1:
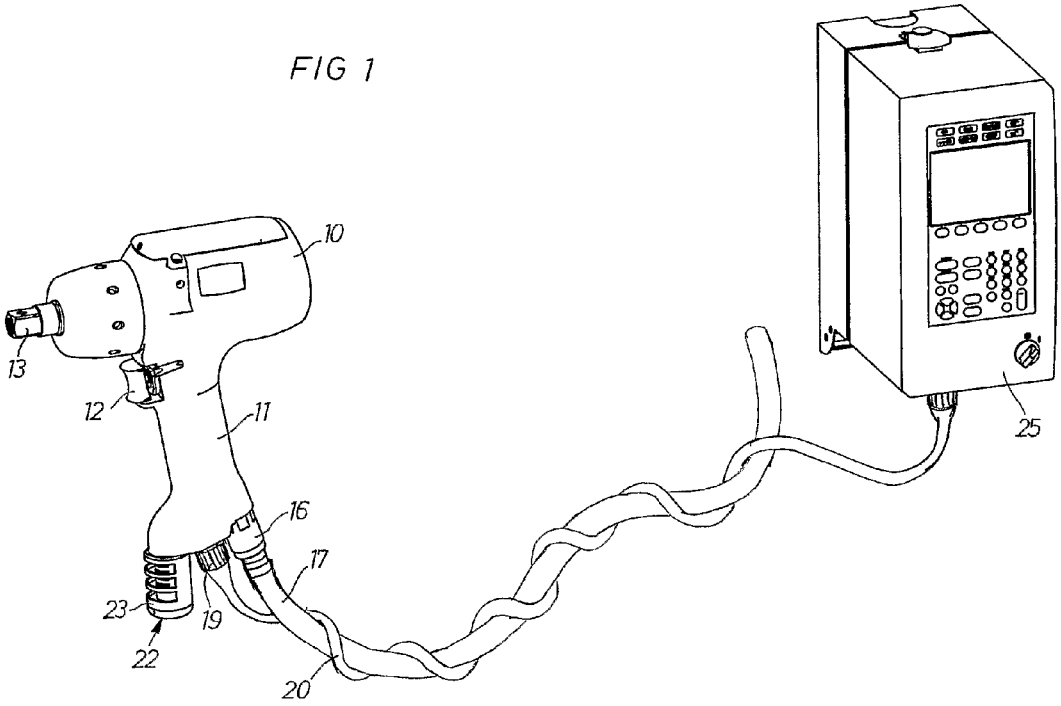
FIG. 1 shows a perspective view of a pneumatic impulse wrench connected to an operation control unit.

The power wrench shown in FIG. 1 comprises a housing 10 with a handle 11 and a throttle valve trigger 12. In the housing 10 there is supported a rotation motor, and an output shaft 13 is coupled to the motor via a non-illustrated hydraulic impulse generator. The handle 11 is also provided with a connection 16 for a pressure air supply conduit 17, a connection 19 for an electric cable 20, and an exhaust valve 22 provided with an outlet deflector 23 for directing exhaust air flow in a desired direction. The pressure air supply conduit 17 connects the impulse wrench to a pressure air source, whereas the cable 20 connects the impulse wrench to a remotely located stationary electronic process control unit 25. The control unit 25 is programmable to be able to make the impulse wrench carry out screw joint tightening operations according to desired tightening strategies.

The impulse wrench is provided with a means for indicating the output torque. Though not illustrated in detail, the impulse wrench comprises a torque indicating means in the form of a means arranged to deliver electric signals in response to the angular displacement of the inertia drive member of the impulse generator, wherein these signals are treated by electronic components onboard the wrench such that the rotation responsive signals are transformed into torque responsive output signals to be sent to the control unit 25 via a wiring 26 and the cable 20. This type of torque indicating means is previously known per se and does not form any part of this invention. See Swedish Patent 527 512. It is to be noted that other types of torque indicating or torque sensing means, like a torque transducer associated with the output shaft, may as well be used.

Figure 2:
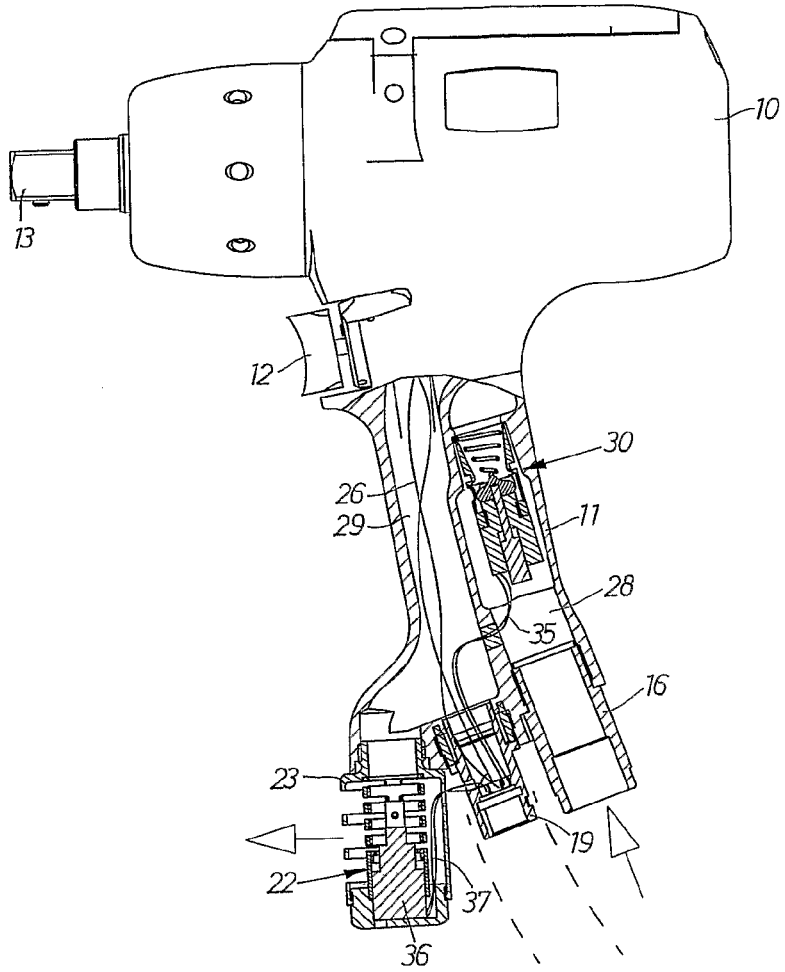
FIG. 2 shows on a larger scale and partly in section a side view of the wrench in FIG. 1.

As illustrated in FIG. 2 the handle 11 comprises an air inlet passage 28 for communicating pressure air from the pressure air supply conduit 17 to the motor, and an outlet passage 29 for ducting exhaust air from the motor out of the wrench housing 10 via the exhaust valve 22 and the outlet deflector 23. In the inlet passage 28 there is located a non-illustrated throttle valve and an on-off valve 30. The latter is a bi-position valve comprising a movable valve element 31 and a seat 32, wherein the valve element 31 is biased toward an open position of the valve 30 by a spring 33 and arranged to be shifted to a closed position by an electromagnetic actuator 34. The latter is activated by electric power supplied via the cable 20 and a wiring 35 from the control unit 25 to stop the motor and end the tightening process.

Figure 4:
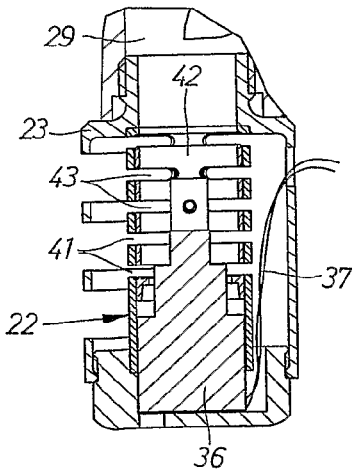
FIG. 4 shows a longitudinal section through an exhaust valve comprised in the impulse wrench in FIGS. 1 and 2.
Figure 3:
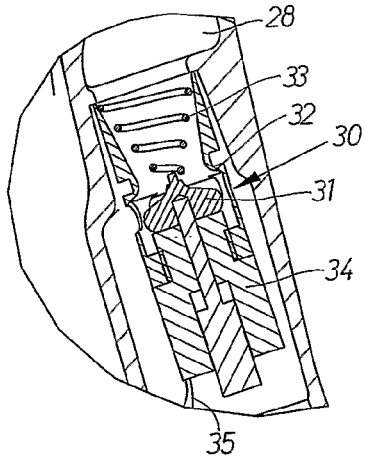
FIG. 3 shows a longitudinal section through an inlet valve comprised in the impulse wrench in FIGS. 1 and 2.

The exhaust valve 22 is mounted at the outer end of the outlet passage 29 and arranged to control the exhaust air flow from the motor. The exhaust valve 22 is a proportional valve activated by a linearly operating electromagnetic actuator 36 connected to the control unit 25 via a wiring 37 and the cable 20. The very design of the electromagnetic actuator 36 is not crucial for the operation of the exhaust valve 22 and is therefore illustrated schematically only in FIGS. 2 and 4. The exhaust valve 22 comprises a tubular valve casing 40 formed with a number of part-circumferential slots 41, and a valve element 42 longitudinally displaceable in the valve casing 40. The valve element 42 is also formed with a number of part-circumferential slots 43 arranged to coincide with the slots 41 of the valve casing 40 in an open position of the valve 22. See FIG. 4. By this multiple slot design of the valve casing 40 and the valve element 42 there is obtained a very short axial movement range of the valve element 42 between a fully open position and a closed position. This means a short and compact design of the exhaust valve 22.

As to the operation of the impulse wrench according to the invention it is important to accomplish an accurate control of the screw joint tightening process such that the delivered impulse energy is adapted to the characteristic of the actual screw joint to thereby safely obtain the desired target pretension condition of the screw joint. A functional feature of impulse wrenches is that the impulse generator may deliver a very high energy first impulse due to a relatively high rotation speed obtained during the initial low resistance pre-seating sequence. Such an initial high energy impulse becomes particularly strong at so called stiff screw joints, i.e. screw joints having a steep torque growth to rotation angle relationship. In certain cases this initial impulse may be strong enough to bring the screw joint directly to a pretension level above the target level. In order to avoid overtightening of the screw joint due to such an initial high energy impulse the control unit is programmed to start the tightening process by operating the wrench motor at reduced power. After the very first delivered impulse or impulses the motor power is increased and continuously adjusted to adapt the impulse energy of the succeeding impulses to the characteristic of the actual screw joint. As the installed torque approaches the target level the motor power is normally also reduced to avoid overtightening.

During the tightening process the inlet valve 30 is kept open by the spring 33, i.e. the valve element 31 is kept at a distance from the seat 32 allowing pressure air to pass unrestrictedly. When reaching the target torque or pretension level the control unit 25 send a signal via cable 20 and wiring 35 to the actuator 34 resulting in a shifting of the valve element 31 to closed position in cooperation with the seat 32. Now, the wrench motor is stopped and the tightening action of the wrench is interrupted.

As described above, the control of the wrench motor power output is accomplished by a program installed in the control unit 25 in the response to feed back signals received from the torque indicating device onboard the impulse wrench. The power control is carried out by adjustment of the opening area of the exhaust valve 22, which means that the exhaust air flow from the motor is more or less restricted by displacement of the valve element 42 in relation to valve casing 40 such that the opening slots 43 of the valve element 42 more or less coincide with slots 41 of the valve casing 40. The exhaust air flow through the exhaust valve 22 is continuously adjusted between different flow magnitudes so as to continuously adapt motor power to the instantaneously reported torque output from the torque indicating device, thereby avoiding a too fast torque growth in the screw joint with a risk for overtightening the screw joint on one hand or a too slow tightening operation on the other hand. The latter case may occur in case of a soft screw joint, i.e. a screw joint with a slow torque growth in relation to rotation angle. An undesired initial high energy impulse is avoided by starting the tightening process with a reduced exhaust air flow as described in connection with previously known impulse wrench systems.

By having a continuously fast acting exhaust air flow control and a fast acting air supply shut-off feature it is possible to obtain an accurate tightening process control and a universally adaptable system for tightening screw joints of different torque growth characteristics.

The invention claimed is:

1. A pneumatic impulse wrench for tightening screw joints, comprising:

a housing having an air inlet passage, an exhaust air outlet passage, and a manually operated throttle valve;

a motor;

an output shaft;

an impulse unit coupling the motor to the output shaft;

a torque indicating unit which generates electric signals in response to an output torque;

an electrically activated inlet valve; and a programmable operation control unit which communicates with the impulse wrench, wherein the inlet valve is located in the air inlet passage and is arranged to control the air flow through the air inlet passage;

wherein an electrically activated exhaust valve is arranged on an outlet side of the motor to control the exhaust air flow through the exhaust air outlet passage;

wherein the control unit is configured to individually activate said inlet valve and said exhaust valve in accordance with a programmed tightening strategy and in relation to signals received from the torque indicating unit;

wherein said exhaust valve is a proportional valve which is continuously adjustable and which is arranged to be activated in response to signals from the control unit for regulating the exhaust air flow during a screw joint tightening process; and wherein said inlet valve comprises a bi-position valve shiftable between an open position and a closed position, wherein said inlet valve is spring biased towards the open position and is arranged to be shifted towards the closed position by the control unit to interrupt a tightening process as a tightening target condition is reached.

2. The impulse wrench according to claim 1, wherein said exhaust valve is arranged to be activated by a linearly operated electromagnetic actuator.

3. The impulse wrench according to claim 2, wherein said inlet valve comprises and is arranged to be shifted towards the closed position by an electromagnetic actuator activated by the control unit.

4. The wrench according to claim 3, wherein the control unit is configured to continuously adjust said exhaust valve during the tightening process between a flow restricting condition during an initial stage of a tightening process, high flow conditions during a pre-tensioning phase of the screw joint, and a flow restricting condition when approaching the tightening target condition of the screw joint.

5. The wrench according to claim 2, wherein the control unit is configured to continuously adjust said exhaust valve during the tightening process between a flow restricting condition during an initial stage of a tightening process, high flow conditions during a pre-tensioning phase of the screw joint, and a flow restricting condition when approaching a tightening target condition of the screw joint.

6. The wrench according to claim 1, wherein the control unit is configured to continuously adjust said exhaust valve during the tightening process between a flow restricting condition during an initial stage of a tightening process, high flow conditions during a pre-tensioning phase of the screw joint, and a flow restricting condition when approaching a tightening target condition of the screw joint.

7. A pneumatic impulse wrench for tightening screw joints, comprising:

a housing having an air inlet passage, an exhaust air outlet passage, and a manually operated throttle valve;

a motor;

an output shaft;

an impulse unit coupling the motor to the output shaft;

a torque indicating unit which generates electric signals in response to an output torque;

an electrically activated inlet valve; and a programmable operation control unit which communicates with the impulse wrench, wherein the inlet valve is located in the air inlet passage and is arranged to control the air flow through the air inlet passage;

wherein an electrically activated exhaust valve is arranged to control the exhaust air flow through the outlet passage;

wherein the control unit is configured to individually activate said inlet valve and said exhaust valve in accordance with a programmed tightening strategy and in relation to signals received from the torque indicating unit; and wherein the control unit is configured to continuously adjust said exhaust valve during the tightening process between a flow restricting condition during an initial stage of a tightening process, high flow conditions during a pre-tensioning phase of the screw joint, and a flow restricting condition when approaching a tightening target condition of the screw joint.

* * * * *